United States Patent [19]

Sugita

[11] 4,085,554

[45] Apr. 25, 1978

[54] METHOD TO DRESS A GRINDING WHEEL

[75] Inventor: Terumitsu Sugita, Narashino, Japan

[73] Assignee: Seiko-Seiki Kabushiki Kaisha, Japan

[21] Appl. No.: 739,854

[22] Filed: Nov. 9, 1976

[30] Foreign Application Priority Data

Nov. 11, 1975 Japan ..... 50-135552

[51] Int. Cl.[2] ..... B24B 1/00

[52] U.S. Cl. ..... 51/325; 51/165.87; 125/11 NT

[58] Field of Search ..... 51/281 R, 165.87, 165.92, 51/325; 125/11 R, 11 H, 11 NT

[56] References Cited

U.S. PATENT DOCUMENTS

| | | | |
|---|---|---|---|
| 3,589,077 | 6/1971 | Lenning | 51/165.92 |
| 3,763,844 | 10/1973 | Stevens | 51/165.87 |

*Primary Examiner*—Harold D. Whitehead

*Attorney, Agent, or Firm*—Robert E. Burns; Emmanuel J. Lobato; Bruce L. Adams

[57] ABSTRACT

A method of dressing a grinding wheel in which a dressing tool repeatedly traverses across the grinding wheel for successively dressing it. A force developed between the dressing tool and the grinding wheel during each traverse of the dressing tool across the grinding wheel is measured, and the measured forces are used to determine when the grinding wheel has been sufficiently dressed. This determination is made by computing the difference between the values of successive forces measured during successive traverses of the dressing tool across the grinding wheel. Alternatively, the determination is made by computing the differential rate of change of the successive forces developed between the dressing tool and the grinding wheel. In either case, traversing of the dressing tool across the grinding wheel is terminated when the computed value is less than a certain predetermined value.

4 Claims, 7 Drawing Figures

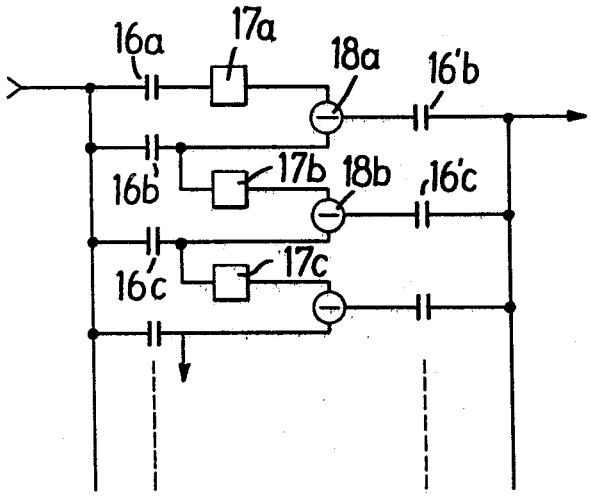
FIG. 5
FIG. 6
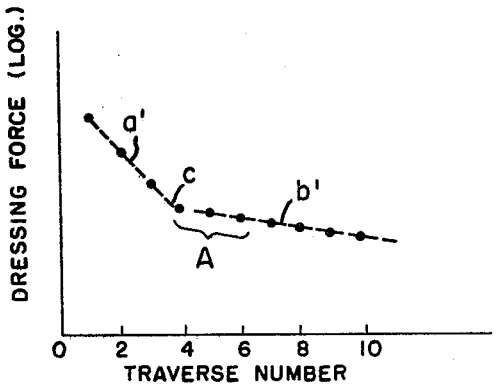
FIG. 7
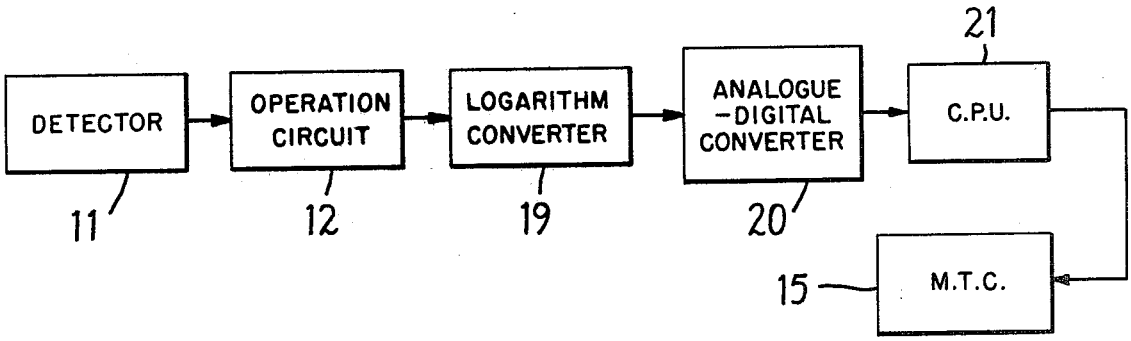

METHOD TO DRESS A GRINDING WHEEL

BACKGROUND OF THE INVENTION

This invention relates to a method of dressing a grinding wheel by a series of dressing steps during each of which dressing force is detected for controlling the number of steps of the operation.

In the example for conventional internal grinder shown in FIG. 1 a wheel table 2 having a grinding wheel speedle 1 thereon is movable in the axial direction of the spindle and an infeed table 4, having a work spindle (not shown in the drawing) which holds and drives a workpiece 3, is fed in a perpendicular direction to the wheel spindle 1. A dressing tool or dresser 5 is provided on one side of the infeeding table 4 and, after infeeding the infeeding table 4 by a predetermined amount and fixing the table there, the wheel table 2 is traversed to the dresser 5 by one or plural traverses.

It is usual in conventional grinding to determine an infeeding amount and the number of traverses of the dressing tool based on experience. But, it is very difficult to obtain best cutting edges on the wheel with this conventional dressing method, because the forming condition of cutting edges on the grinding wheel in a dressing process greatly affected by the kind (material) and the shape of the wheel, the shape of the diamond dresser and other parameters. Particularly in dressing a new-developed super hard grinding wheel (e.g. Borazon Grinding Wheel), a greater number of traverses than usual is required for dressing the wheel. Less than a required number of traverses is not enough for refreshing the abrasive gains of the wheel after a predetermined dressing infeed, while an excessive number of traverses brings loading on the wheel.

Both of the unsuitable numbers of traverses deteriorate grinding ability of the wheel. Further, in this particular manner of dressing, the most suitable number of traverses changes due to changes of the condition of the wheel to be dressed and to the wheel shape. Accordingly, it is preferable to select the number of traverses at every dressing operation according to the wheel condition or shape.

The inventor has, in an analysis of an experiment investigating dressing force and its relation to traverse number of the wheel table, discovered the phenomenon that dressing force decreases sharply at first but after that slowly decreases as traverse number increases as shown in FIG. 2 and the best cutting edge is formed on the grinding wheel in area A of the dressing force characteristic curve where the reducing ratio of dressing force suddenly changes to a small value.

SUMMARY OF THE INVENTION

It is an object of the present invention to provide a dressing method for a grinding wheel, wherein best cutting edges are attained on the wheel, by stopping a dressing operation when the dressing force decreases by progressively smaller amounts upon continuation of the dressing operation.

This and other objects are attained by detecting a smaller difference between successive dressing forces than a predetermined value and then generating a termination signal for terminating the dressing operation.

BRIEF DESCRIPTION OF THE DRAWINGS

FIG. 5 is a circuit diagram of the subtraction circuit represented in FIG. 4;

FIG. 6 illustrates the characteristic curve of FIG. 2 plotted on semilogarithmic coordinates; and FIG. 7 is a block diagram of a circuit for controlling grinding wheel dressing according to another embodiment of the method according to the present invention.

DETAILED DESCRIPTION OF THE PREFERRED EMBODIMENTS

Referring now to the attached drawings, some preferred embodiments will now be described hereinafter.

Figure 3:
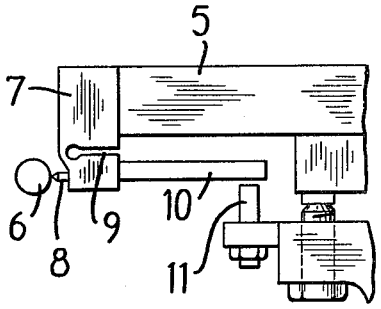
FIG. 3 is a partial elevation view showing structure for measuring a dressing force developed between a grinding wheel and a dressing tool.

In FIG. 3, a slit 9 is provided on a dresser holder 7 parallel to the axis of a diamond dresser 8 or dressing tool. A dressing frame 5 which has dresser holder 7 is movable to and from a grinding wheel 6. Dresser holder 7 has a magnifying bar 10 extending from the rear end thereof and, which is placed lower than slit 9. A detector 11 for detecting displacement of bar 10 is placed on the infeed table facing the remote end of bar 10 with a proper gap therebetween. In dressing the grinding wheel, the infeed table advances to the grinding wheel until diamond dresser 8 is in contact with grinding wheel 6, and then the dressing frame 5 is fed toward the wheel by a predetermined amount while the rotating wheel spindle is reciprocated in the axial direction thereof by reciprocating displacement of the wheel table, whereby the grinding wheel is dressed by the diamond dresser 8. In this dressing process, dresser holder 7 is slightly bent counterclockwise in FIG. 3 at the lower portion by a dressing force on diamond dresser 8, so that bar 10 fixed on the lower portion of dresser holder 7 is rotated around the thin portion of dresser holder 7, moving away from detector 11. This movement is detected by detector 11 and is converted into an equivalent dressing force according to a previously measured relation between the movement of bar 10 and the dressing force.

Figure 4:
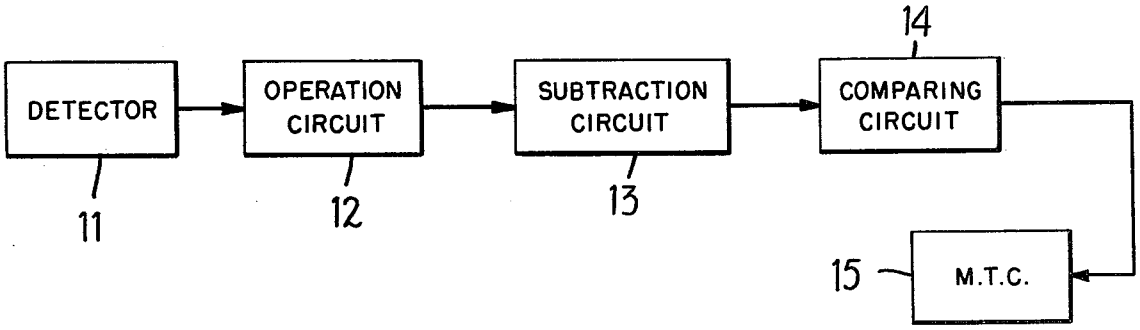
FIG. 4 is a block diagram illustrating circuitry for controlling grinding wheel dressing according to the method of the present invention.

FIG. 4 is a block diagram showing a method for controlling grinding wheel dressing according to this invention in which numeral 12 designates an operation circuit for converting a peak value of the output from said detector 11 into dressing force at every traverse movement of grinding wheel 6, across the dressing tool 8 and numeral 13 designates a subtraction circuit to compute the difference between consecutive dressing forces Pn and Pn-1 ($n=1, 2, \ldots$) which are fed from operation circuit 12 and stored successively in the subtraction circuit.

FIG. 5 shows a detailed example of said subtraction circuit 13, wherein a dressing force $P_1$ developed during a first traverse of the wheel is stored in an analogue memory **17*a* by way of a contact 16*a* which is closed, and wherein another dressing force $P_2$ developed during a second traverse is stored in a second analogue memory 17*b* by way of a contact 16*b* which is next closed. A subtractor 18*a*** computes and generates an output by subtraction of second dressing force $P_2$ from first dressing force $P_1$, and the output is fed through a contact 16'b. In the same way, a dressing force $P_3$ developed during a third traverse is stored in an analogue memory 17c through a contact 16c which is then closed and is subtracted from second dressing force $P_2$ in a subtracter 18b, the output of subtracter 18b being fed through a contact 16'c. Thus, in subtraction circuit 13, dressing forces from operation circuit 12 are successively stored and the differences (Pn−1 − Pn) are successively computed from successive dressing forces developed during consecutive traverses. Numeral 14 designates a comparing circuit to compare the difference of dressing forces Pn−1 − Pn with a preset value $\epsilon$ and to generate a dressing finish signal when the difference Pn−1 − Pn becomes less than value $\epsilon$. This value $\epsilon$ is previously selected experimentelly by checking the relation between the grinding ability of the wheel and the difference between consecutive dressing forces. Numeral 15 designates a machine-tool controller to control the wheel table feed and the infeed table feed. The controller 15 stops the traversing motion of the wheel table upon receiving the dressing finish signal from comparing circuit 14.

Receiving pulse signals for enabling operation circuit 12 to receive the output of detector 11 at every traverse of wheel table 2 can be generated by the operation of limit switches positioned for detecting both ends of the wheel table travel.

Figure 1:
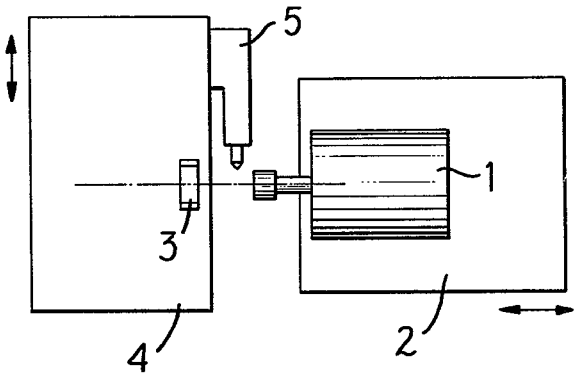
FIG. 1 is a plan view of an internal grinder for carrying out the method according to the present invention.
Figure 2:
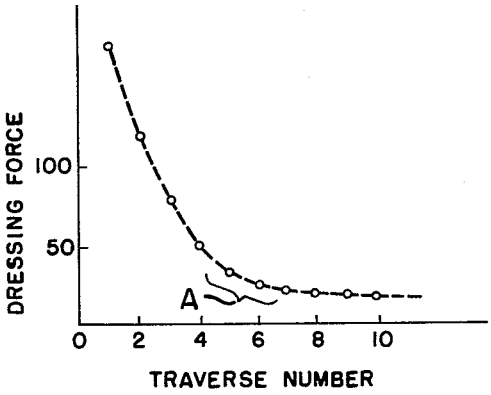
FIG. 2 is a graph illustrating the relationship between dressing force and number of traverses of a dressing tool across a grinding wheel.

The dressing force curve in FIG. 2 may be approximately converted into a pair of straight lines a' and b' having a bending point C on a semi-logarithm graph as shown in FIG. 6. A second embodiment of the invention, which will be described hereinafter, uses the bending point C for detecting dressing finish as the area A is close to the bending point C.

FIG. 7 is a block diagram of another embodiment of the invention, in which some reference numerals indicate the same structure as in FIG. 4. The output of operation circuit 12 is fed to a logarithm converter 19. Numeral 20 designates an analogue-digital converter to convert the output of logarithm converter 19 into digital signals. Numeral 21 designates a C.P.U. to compute the differential rate of logarithmic dressing forces $P_1$, $P_2$ . . . which are generated at logarithm converter 19 and to generate a dressing finish signal when the differential rate becomes less than a predetermined value. This signal is fed to machine-tool controller 15 for stopping infeed of the infeed table.

More particularly, the differential rate of change of logarithmic dressing forces $P_1$ and $P_2$, the differential rate of change of logarithmic dressing forces $P_2$ and $P_3$, the differential rate of change of logarithmic dressing forces $P_3$ and $P_4$, . . . are successively computed. C.P.U. 21 detects a sudden change of the differential rates, i.e. area A at the transition from line a to line b in a manner in which a successive train of logarithmic dressing forces ($P_1$, $P_2$ and $P_3$) or ($P_2$, $P_3$ and $P_4$) . . . are stored and differences $(P_1 - P_2) - (P_2 - P_3)$ or $(P_2 - P_3) - (P_3 - P_4)$ . . . are successively computed using the three values, the computed value being compared with a predetermined value $\epsilon$. Thus, when the computed value becomes less than $\epsilon$, the dressing finish signal is generated.

According to the invention, dressing force is successively detected during each wheel traverse and the number of traverses is determined on the dressing force, so that suitable dressing can be performed and the best cutting edges are attained on the grinding wheel with a traverse number most suitable for the shape and the surface condition of the wheel.

I claim:

1. A method of dressing a grinding wheel, comprising:
   - positioning a dressing tool relative to a grinding wheel for dressing the same;
   - repeatedly traversing the dressing tool across the grinding wheel;
   - measuring a force developed between the dressing tool and the grinding wheel during each traverse of the dressing tool across the grinding wheel;
   - determining from the forces measured during each traverse of the dressing tool when the grinding wheel has been sufficiently dressed; and
   - terminating traversing of the dressing tool across the grinding wheel to complete the dressing operation when said measured force reaches a predetermined value so that the grinding wheel has been sufficiently dressed.

2. A method according to claim 1, wherein the steps of determining when the grinding wheel has been sufficiently dressed, and terminating traversing of the dressing tool comprise:
   - computing the difference between the values of successive forces measured during successive traverses of the dressing tool across the grinding wheel; and
   - terminating traversing of the dressing tool across the grinding wheel to complete the dressing operation when the difference between successive forces developed between the dressing tool and the grinding wheel during successive traverses is less than a certain predetermined value.

3. A method according to claim 1, wherein the steps of determining when the grinding wheel has been sufficiently dressed, and terminating traversing of the dressing tool comprise:
   - computing the differential rate of change of the successive forces developed between the dressing tool and the grinding wheel during successive traverses of the dressing tool; and
   - terminating traversing of the dressing tool across the grinding wheel to complete the dressing operation when the differential rate of change of the successive forces developed between the dressing tool and the grinding wheel is less than a certain predetermined value.

4. A method according to claim 1, further comprising the step of converting the measured values of forces developed between the dressing tool and the grinding wheel into logarithmic values; and wherein the steps of determining when the grinding wheel has been sufficiently dressed, and terminating traversing of the dressing tool comprises:
   - computing the differential rate of change of the logarithms of the values of the successive forces developed between the dressing tool and the grinding wheel during successive traverses of the dressing tool; and
   - terminating traversing of the dressing tool across the grinding wheel to complete the dressing operation when the differential rate of change of the logarithms of the values of the successive forces developed between the dressing tool and the grinding wheel is less than a certain predetermined value.

* * * * *